United States Patent [19]

Zitzow

[11] 4,063,531

[45] Dec. 20, 1977

[54] COATER FOR BOTH SIDES OF TRAVELING WEB

[75] Inventor: Clarence R. Zitzow, Beloit, Wis.

[73] Assignee: Beloit Corporation, Beloit, Wis.

[21] Appl. No.: 654,859

[22] Filed: Feb. 3, 1976

[51] Int. Cl.[2] ..... B05C 5/02; B05C 11/04

[52] U.S. Cl. ..... 118/122; 118/411

[58] Field of Search ..... 118/122, 123, 126, 411, 118/422, 227, 228, 226; 427/209

[56] References Cited

U.S. PATENT DOCUMENTS

| | | | |
|---|---|---|---|
| 1,632,760 | 6/1927 | Jones | 118/122 X |
| 1,676,363 | 7/1928 | Seidell et al. | 118/122 X |
| 2,372,248 | 3/1945 | Bonton | 118/122 X |
| 2,489,985 | 11/1949 | Speight, Jr. | 118/122 UX |
| 2,624,914 | 1/1953 | Rhodes | 118/227 X |
| 3,448,666 | 6/1969 | Kappelhoff et al. | 118/411 X |
| 3,575,134 | 4/1971 | Quint | 118/122 |
| 3,675,621 | 7/1972 | Griffin et al. | 118/122 |
| 3,930,464 | 1/1976 | Wallsten | 118/122 |

*Primary Examiner*—James Kee Chi

*Attorney, Agent, or Firm*—Hill, Gross, Simpson, Van Santen, Steadman, Chiara & Simpson

[57] ABSTRACT

A method and mechanism for applying a liquid coating to both sides of a traveling web including guiding the traveling web along a substantially vertical path through a coating station applying coating continuously across the width of the web hydraulically and in one form the web traveling vertically upward and the excess coating falling downwardly and being directed away from the web, applying a uniform smoothing and distributing pressure to the surface of the coating by pressing first and second opposed thin flexible smoothing blades having a smooth inner surface with sufficient pressure so that the blades bend at an arc and the arc is tangent to the surface of the web.

14 Claims, 6 Drawing Figures

65
66
63
60
59
73
58
62
74a
64
61
57
74
75
12
56
50
51
48
49
47
46
54
55
52
53
48a
49a
71
68
67
37b
70
11
42
44
45
43
3
15a
16a
14
15
16
17
19
24
25
20
21
22
18
40
31
41
36a
30
37a
35
36
34
26
27
37
68
29
28
38
32
33
39
W
10
69

12
76
77
86
87
80
81
82
83
96
90
90a
88
89
91
92
78
79
84
85
97
98
93
94
W

COATER FOR BOTH SIDES OF TRAVELING WEB

The present invention relates to improvements in coaters and particular to coaters well suited for use in the paper making industry which move a continuous web of paper through a coating station applying the coating to both sides of the web and smooth the applied coating.

In the paper making art many types of paper are coated on either one or both sides with a coating material which gives the paper web certain necessary qualities for the purpose for which it is to be used. Generally, a coating is applied to give the paper a gloss and thickness and to provide ink receptivity. Different types of coatings are employed which are applied in a liquid form usually referred to in the coating art as color. The various liquid substances applied to the traveling web will be generically referred to herein as a coating, and while the features of the invention may be adopted for use in coating other types of traveling web, they are particularly well-adpated for use in the paper field and the invention will be described in this environment.

In the coating of paper an overall objective is to completely cover paper fibers on both sides of the web and be uniform in thickness and coat weight throughout the width of the sheet. A general objective is to provide a method and apparatus which can apply the coating of the thickness desired and to obtain complete uniformity and smoothness without gaps, or ridges or lumps or other imperfections appearing in the surface and do this at a relatively high rate of speed without requiring shutdown for servicing or cleaning. In structures and methods heretofore used high speeds were often impractical and versatility was not available in being able to handle coatings of different thicknesses and characteristics. Other problems which were encountered were film splitting which was particularly true on low grade papers. Efforts to create a high speed coater which was capable of uniform coating operation without film splitting and without defects have resulted in structures which may be categorized as bar coaters or blade coaters. In the bar type of coater, the coating was applied to the surface and smoothed by being engaged with a bar. This type of coater has proven to have critical dependence on web tension with decreasing tension resulting in heavier application of coating thereby creating the need for accurate control of web tension or having to contend with the resulted nonuniform coating application. This also created a difficulty on wide machines where the web tended to have nonuniform contact with the metering bar. Further increasing the speed of operation of the coater increased hydrodynamic forces on the color and enframed air caused instability of the unsupported web giving rise to uneven application.

In another type of coater a blade was applied to the web to smooth the coating but this was not wholly satisfactory because a highly absorbent sheet would frequently result in the coating material dewatering rapidly and dry particles of pigment would lodge behind the blade and start streaking. This was increased by the sheet being warm when used for on machine coating. Also fibers were torn off of the surface of the web by the blade creating streaking and nonuniform effects. This type of coater often result in a mottled pattern with brightness variations due to differences in depth of the coating layer and this resulted in uneven printing ink absorption. Types of coaters applying blades to the surface are shown in prior art patents such as Swedish Pat. No. 347,781, German Pat. No. 1,308,186 and U.S. Pat. Nos. 2,946,307, 297,564, 3,489,592 and 3,575,134. These patents apply or smooth the coating on the web by engagement of the web with the blade extending from one side or both sides toward the web and applying or smoothing the coating as the web travels past the blade. The present invention may be classified as a twin blade coater in that it utilizes blades extending toward the traveling web but utilizes unique structure not heretofore used and not obvious from the teaching of the structures of the prior art. Also the structure makes possible to operate a coating machine at higher speeds than heretofore possible and coating at speeds of 3600 feet per minute and the above is quite possible with the uniform and completely satisfactory coating results.

It is accordingly an object of the present invention to provide a superior method and structure for applying a coating to both sides of a traveling web of paper which wil avoid disadvantages of splitting, nonuniform coating, streaking and other surface imperfections which have occured with structures and methods heretofore available.

A further object of the invention is to provide an improved coating machine which makes it possible to operate at higher web speeds than heretofore achieved for commercial operation and which provides capability of operating over a wide range of types of coating and types of web.

A further object of the invention is to provide an improved coating machine which obtains features necessary for a successful commercial machine which embody ease of rethreading, lack of necessity of frequent shutdown for servicing or cleanup, capability of operation with on-line or other coating, and makes cleanup and servicing possible with convenience and rapidity.

A feature of the invention is the provision of a coating machine wherein coating is applied to both sides of a rapidly traveling web of paper and the coating is uniformly smoothed by uniquely constructed smoothers which may be called bent blade smoothers and which employ relatively thin flexible blades having a planar smooth inner surface with the blades being pressed to the web in such a manner as to form a natural arc with the arcs being tangent to the planes of the surface of the traveling paper web. Actually, the arcs are tangent to the plane of the surface of the liquid coating which is offset from the plane of the web a miniscule amount equal substantially to the thickness of the coating layer.

As the web approaches the smoothing and distributing location it contains layers of liquid coatings on both surfaces. While these layers of coating are extremely thin the surface is fluid. At opposite locations thin flexible blades are pressed toward each other with the web traveling therebetween. These blades are of a length so that they form an arc of curvature facing the oncoming coating with the arc being essentially tangent to the fluid coating surface at the location where the opposed blade surfaces are closest to each other. Preferably, the blades are of such a length that the arc continues on so that the blade surfaces slightly separate from each other on the downrunning side of the web. As the liquid coating passes the smoothing point, it is essentially kneaded or worked with the hydraulic pressure in the nip increasing towards such point of tangency as a function of the curvature of the inner smooth surface of the blades. At the point where the blade surfaces are closest together maximum hydraulic pressure is reached and this pressure is released on the offrunning side as the arcs of tangency curve away from the coating surface so that as the coating separates from the blade on the downrunning side it does so with the pressure being gradually released. The exact curvature of the blade surface will be a function of the forces on the opposing sides. The force urging each of the blades towards the web will be caused by the cantilever being force on the blade where it is supported at its upstream end and by the force of a resilient rubber tube which backs the blade extending the length of the blade. The non-linear increase in hydraulic pressure which occurs as the coating enters the smoothing zone of the blades where the blades curve toward the web has been found to have a superior distribution and smoothing effect on the coating in the nip and accomplishes superior results even at high speds.

Other advantages, objects and features will become more apparent, as will equivalent methods and structures which are intended to be covered herein, with the further teaching of the principles of the invention in connection with the disclosure of the preferred embodiments, as illustrated in the drawings in which.

Figure 1:
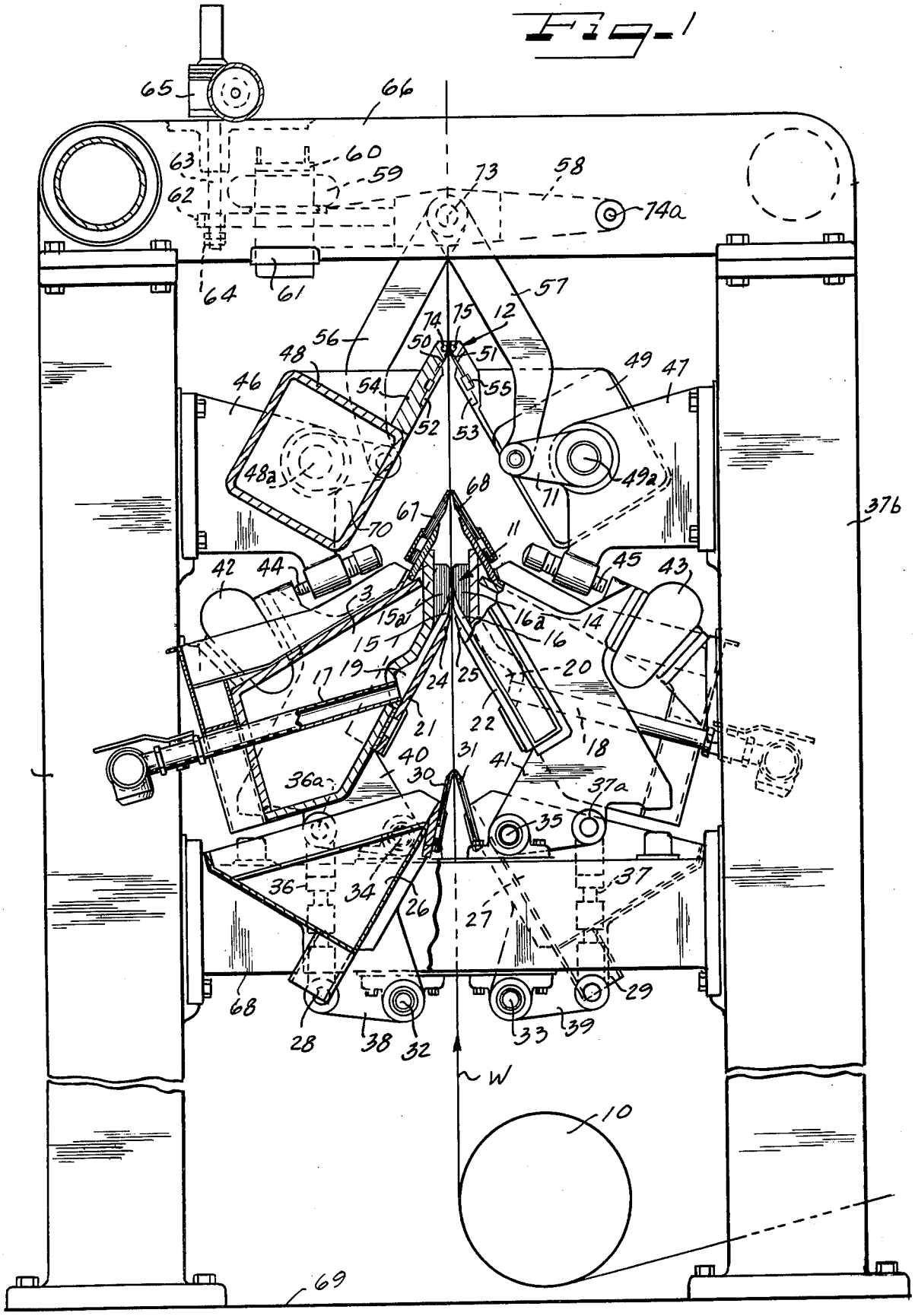
FIG. 1 is an end elevational view, with the left half of the drawing shown in vertical section, of a mechanism constructed and operating in accordance with the principles of the present invention.

As illustrated in FIG. 1, a paper web run W passes over a roll 10 and travels upwardly in a coating run where a layer of coating is applied, distributed and smoothed on the web.

The vertical travel through the mechanism may be referred to as the coating station which includes an applying location 11 and a distributing and smoothing location 12. At the applying station, applying heads 3 and 4 are positioned on either side of the web. These applying heads each include a cross machine extending continuous opening or gap 15 and 16 through which coating flows and is hydraulically applied under pressure against the web. Following the opening is a smooth surface block or head 15*a* and 16*a* which have rounded noses curving toward the web so as to squeeze the liquid coating into the web as it travels upwardly. These blocks may be formed of plastic such as Teflon or polyethylene. The inner surfaces of the blocks 15*a* and 16*a* form the upper edge of the hydraulic openings 15 and 16 through which the coating is applied. The coating applied to each side of the sheet may be the same substance or a different coating or different physical characteristics may be applied to each side of the web dependent upon the finished product that is desired.

A coating is pumped to the coating gaps 15 and 16 through a supply line 17 and 18 attached to a suitable supply such as a pressure pump. The flow pipes 17 and 18 are opened into manifold chambers 19 and 20 which are shaped so that the coating follows a generally circular swirling path in the manifold to insure mixing and maintain even uniform flow with the elimination of the lumps or thickened areas as the coating flows upwardly to the hydraulic applying gaps 15 and 16.

The lower edge of the coating applying gaps 15 and 16 is provided by plates 21 and 22 which form the floor of the manifolds 19 and 20. The upper edges 24 and 25 of the plates are spaced slightly from the traveling web so that excess coating flows up over the edges 24 and 25 and due to surface tension, the coating flows down along the lower surface to drop downwardly into save-all pans 26 and 27 which have collecting conduits 28 and 29. These save-all pans also collect extra coating which flows downwardly from the distributing and smoothing location 12 as will be later described.

First or lower deflector plates 30 and 31 are positioned on each side of the web to deflect droplets of coating outwardly which may fall downwardly from the applicator location 11. These plates have upper edges which are positioned in close-running relation with the web. That is, they are positioned as close to the web as they can be brought without scraping or touching the web so that any droplets flow down the outer surface of the deflector blades and for this purpose the upper edge of the plate is tapered so as to come to a relatively sharp edge. The plates are suitably bolted or clamped onto the save-all pans.

The save-all pans with the deflector plates are pivotally supported at 32 and 33, respectively. Positioning arms 38 and 39 are connected to the save-all pans and adjustable expansion links 36 and 37 pivotally connect to the outer ends of the arms 38 and 39 so as to control the position of the deflector plates 30 and 31. The arms have a turnbuckle arrangement so that they can threadably be extended or shortened to pivot the pans about the pivot points 32 and 33 to thereby bring the plates 30 and 31 to the desired close-running position relative to the web.

Mounted at the upper edge of the coating applicator heads are second deflector plates 67 and 68 which also have a tapered relatively sharp upper edge and are brought into a closerunning position relative to the web. That is, they are brought to almost touching position with the coated surfaces on the web and extend downwardly and outwardly so as to catch droplets of coating falling downwardly from the smoothing location 12, preventing it from depositing on the traveling web. The coating falling on the top of the deflector plates 67 and 68 flows downwardly over the top surface of the heads to flow downwardly into the save-all pans 26 and 27.

The applicator heads are positioned by inflatable diaphragms or bellows 42 and 43. These apply pivotal force to the heads to hold the heads in position against the hydraulic pressure of the fluid which is applied to the web through the gaps 15 and 16. Adjustable stops 44 and 45, mounted on arms 46 and 47, control and limit the adjusted position of the heads. The heads are respectively pivoted at pivotal locations 34 and 35. For moving the heads to clean-up position with the blocks 15*a* and 16*a* and the reflector plates 67 and 68 are moved away from the web, the diaphragm bellows 42 and 43 are deflated and the heads will tilt rearwardly away from the web. This will also pivot the lower deflector plates 30 and 31 inasmuch as they are linked to the heads by having the upper end of the adjustable arms 36 and 37 pivotally connected to the heads at 36*a* and 37*a*. When the diaphragm bellows 42 and 43 are again inflated, the heads pivot toward each other with the gap between the heads to determine the slot through which the web moves determined by the adjustment of the stops 44 and 45.

The mechanism for supporting the heads includes two vertical frame posts 36*b* and 37*b* on which the arms 46 and 47 are mounted, and a cross bar 66 between the posts supports the lower pivot bearings. A similar cross bar 66 extends across the top of the posts, which are mounted at their base on a floor 69.

The coating, smoothing and distributing mechanism for location 12 is supported on bars 48 and 49 which are pivoted at 48*a* and 49*a* on the arms 46 and 47. These bars may take various forms and are shown as rectangular tubes having braced arms 54 and 55 extending upwardly therefrom. The bars have pivot arms 70 and 71 which connect at their free ends to vertically extending bent arms 56 and 57. The upper ends of the arms are pivotally connected at 73 to a lever arm 58 which is pivoted at 74*a*. The other end of the lever arm may be lifted upwardly for moving the mechanism to threading and clean-up position, or may be urged downwardly to the normal operating position. For urging the lever arm 58 downwardly, inflatable bellows 59 is mounted on a bracket 60 and urges the lever arm downwardly. The lever arm is limited in its downward movement by an adjustable stop 61.

For lifting the lever arm upwardly a vertical rod 63 extends through an opening 62 in the arm and a nut 64 at the end will lift the arm upwardly when the rod is drawn vertically. The rod forms part of a jack 65 which can be positioned so that the arm 58 is in its operating position so that it flows subject to the pressure of the bellows 59, or when the rod 63 is drawn upwardly and the bellows 59 is collapsed, the bent arms 56 and 57 will pivot the cross bars 48 and 49 outwardly to carry the distributing and smoothing mechanism away from the web.

Figure 2:
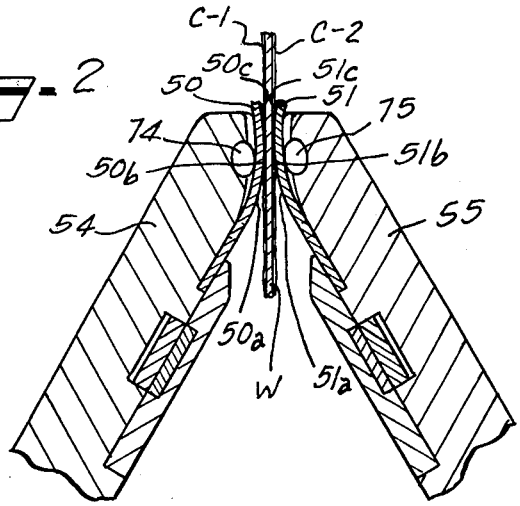
FIG. 2 is an enlarged detailed view of the smoothing blades at the nip.

The distributing and smoothing mechanism includes a pair of flexible blades 50 and 51 which are mounted at their lower ends by plates 52 and 53. The blades are cantilever supported on the plates and curve upwardly in an arc with the arc curving to be tangent to the surface of the traveling web. The head of the nip where the point of tangency occurs is inflatable tubes 74 and 75. This mechanism is shown in greater detail in FIG. 2. As the web W approaches the distributing and smoothing nip, it is fluid on the surfaces of the web. The blades 50 and 51 are essentially cantilever supported at the outer ends on the arms 54 and 55 which press the blades toward the web. The blades assume a natural arc of curvature. On the approaching side of the nip formed between the blades, the arc of the blades 50*a* and 51*a* tapers gradually inwardly in a non-linear curvature determined by the stiffness of the blades and the force which is applied. However, the blades assume a balanced position so that each blade presses against the web with the same pressure because the web will move to a neutral position where the hydraulic pressures on each side are equal and opposite. As the liquid coating passes underneath the smooth inner surface of the blades, it is slightly worked or kneaded by hydraulic pressure against the web. At the points 50*b* and 51*b*, the blades' inner surfaces are closest to each other and at that point, the arc of each of the blades is tangent to the outer plane of the web. Primarily, the curvature is tangent to the outer surface of the two layers of coating C1 and C2 but for purposes of description, reference will be made as to tangency to the surface of the paper. The coating actually will be displaced above and below this point of tangency as the fluid coating is worked. On the off-running side, the blades continue curving outwardly so that the downstream curvature is shown at 50*c* and 51*c* as gradually separating from the coating in the same arc of curvature which the blades took on the oncoming side. This gradually decreases the hydraulic pressure on the coating and effects a smooth departure or separation between the blades and coating creating a smoother coating and eliminating tear, running, and other imperfections on the off-running side of the nip. Any inequalities in the distribution of the coating and any high or low portions or lumps in the coating will have been worked in the gradual approach of the coating oneach side of the web into the nip and the release of the coating on the off-running side of the nip.

Figure 3:
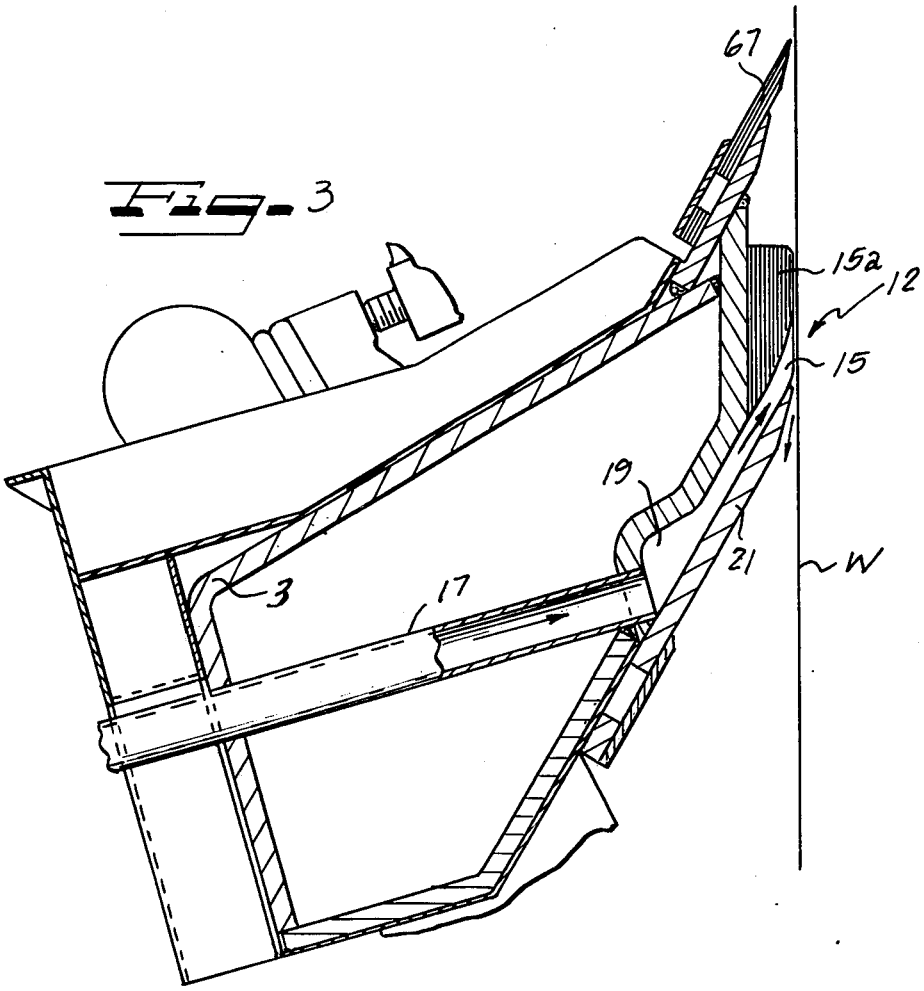
FIG. 3 is a vertical sectional view of the mechanism for applying the coating to the surface of a traveling web.

FIG. 3 shows greater detail of the coating applicator location 12. As above described the coating flows hydraulically through the gap 15 to be pressure-applied to the web and is further pressure-applied by the curved shape of the plastic block 15*a*. The curved mix chamber 19 upstream of the hydraulic gap 15 modulates surges of coating material being emitted from the header pipes 17 which are spaced across the machine width. A continuous recirculating flow is caused by the escaping portion of coating which flows down on the underside of the plate 21.

Figure 4:
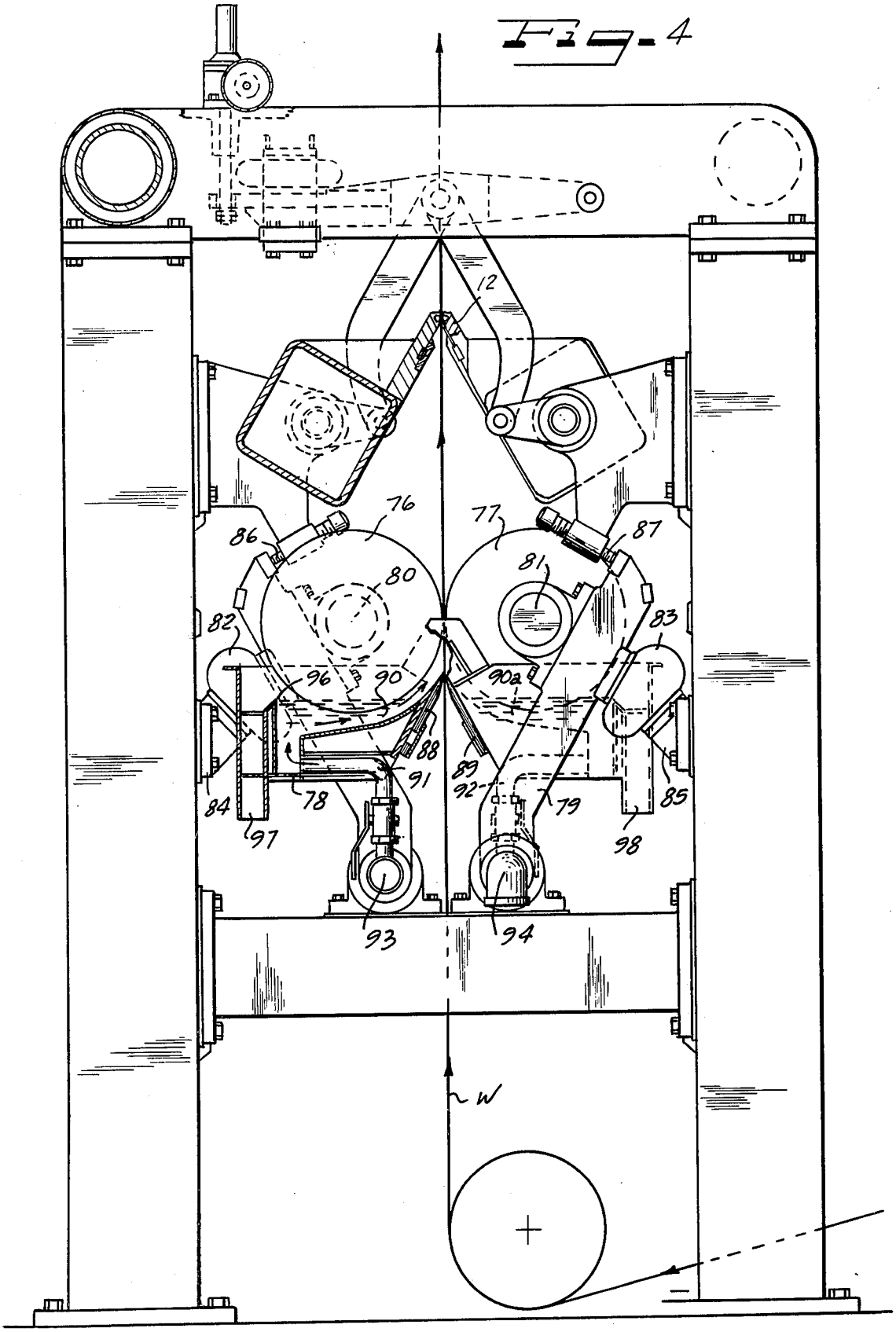
FIG. 4 is an end elevational view, shown partially in vertical section, of the mechanism using another form of structure for applying coating to the web.

In FIG. 4, the mechanism is shown with a different form of coating application construction. The smoothing and distribution location 12 is provided with the same equipment as described in connection with FIG. 1. As the web W travels upwardly, it passes through a nip between opposed rotating applicator rolls 76 and 77. These rolls are carried on pivotal arms 78 and 79 pivoted at their lower ends. The arms move toward each other to determine the distance between the opposed applicator rolls 76 and 77 and hence the pressure in the nip against the web. Adjustable stops 86 and 87 are engaged by the arms to determine the operating location. The arms are urged toward each other to urge the rolls 76 and 77 toward each other by inflatable bellows 82 and 83 which are mounted on brackets 84 and 85 on vertical columns. The rollers are mounted in end bearings 80 and 81 on the arms.

A coating is applied to the nip on the approaching side of the rolls as the web travels upwardly through arcuate channels 90 and 90*a* which deliver coating under pressure to the outer surface of the rolls. The lower portion of the channels 90 and 90*a* next to the traveling web is formed by blades 88 and 89 which have their outer edges in close running relation to the web W. A coating is delivered upwardly through supply pipes 91 and 92 from headers 93 and 94. A surplus of coating is supplied so that a continuous flow is experienced and excess coating will flow over a dam such as shown at 96 and flows outwardly through return lines 97 and 98.

Figure 5:
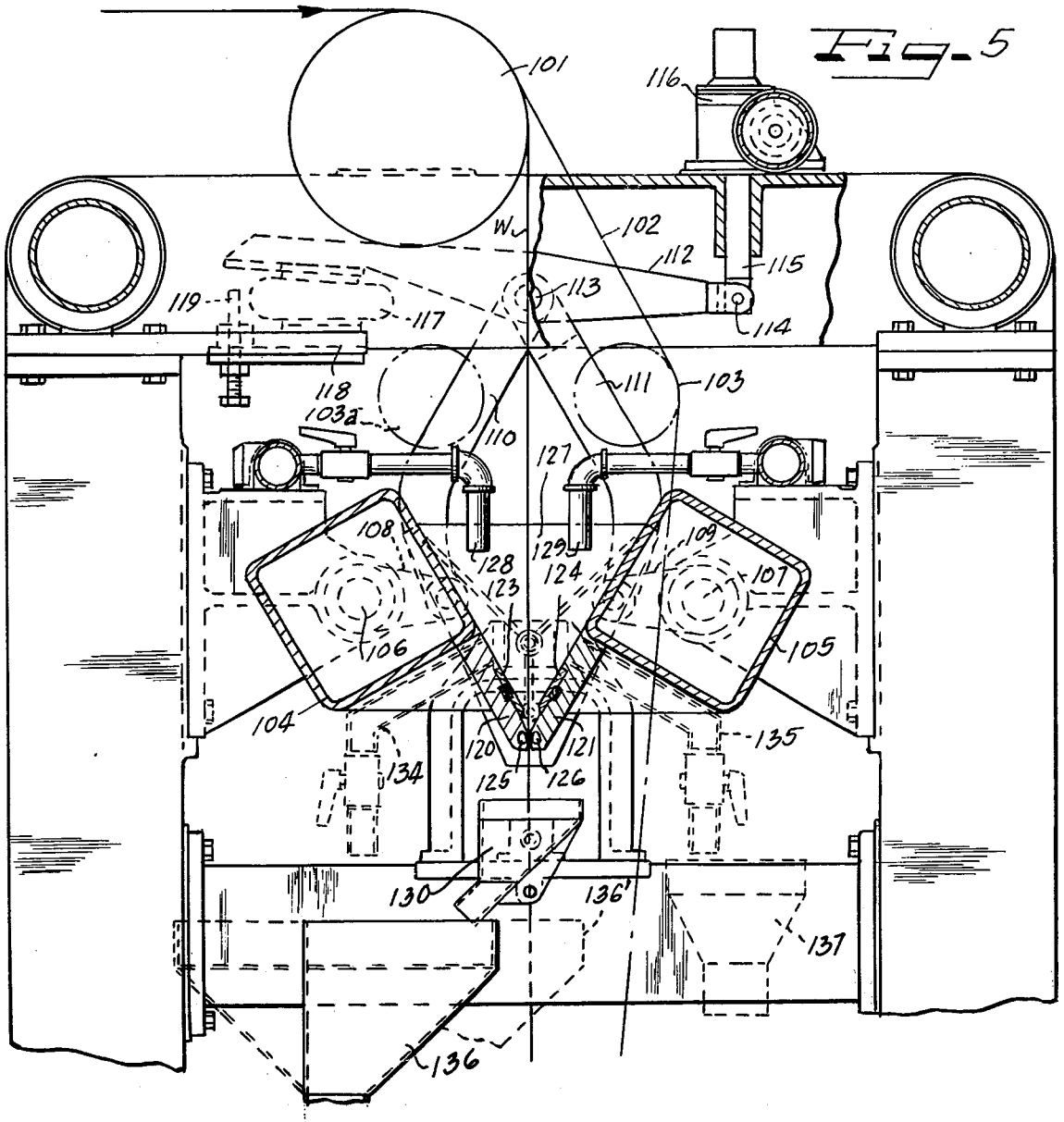
FIG. 5 is an end elevational view shown largely in section of another form of the mechanism using a downrunning web.
Figure 6:
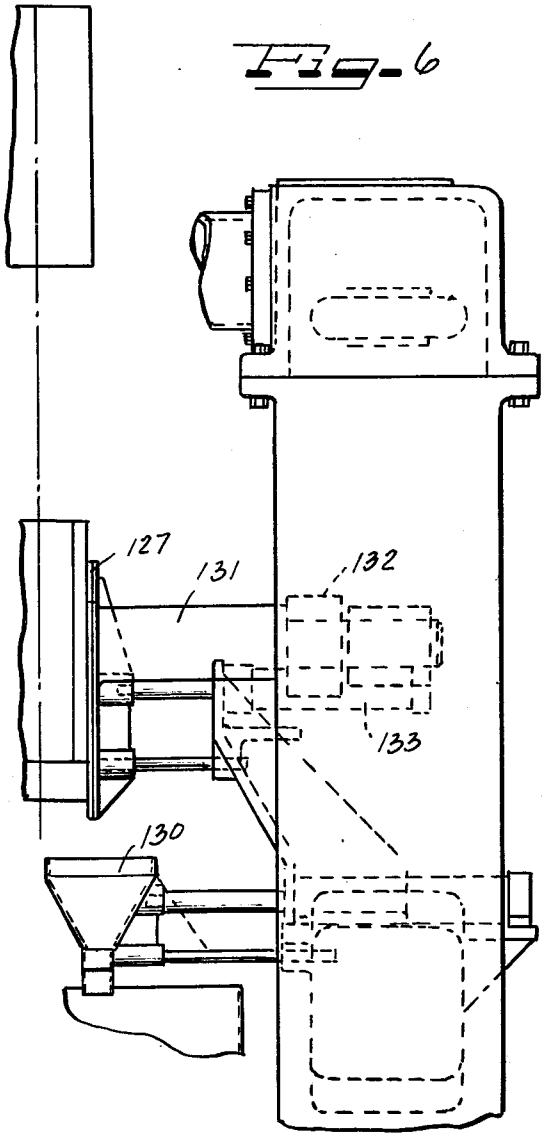
FIG. 6 is a fragmentary side elevational view of one side of the machine.

FIGS. 5 and 6 illustrate another form of structure embodying the concepts of the invention wherein the web is coated in the vertical run but the web travels in a downward direction. The web W passes over guide roll 101 and travels downwardly and the coating is applied and smoothed in a downward coating run. A rope sheave 102 threads the web downwardly through the coating station and is guided by a movable guide roll 103 which moves from the position 103*a* during coating to a position 103 during operation so that the sheave is out of the way and does not remain in the nip between the coating blades.

The coating blades are supported on cross rods 104 and 105 extending across the width of the machine and pivoted at 106 and 107 respectively. Pivot arms 108 and 109 pivot the rods between the operating position as illustrated, and a clean-up and threading position wherein the blades are moved away from the web. For this purpose, vertical bent arms 110 and 111 connect to the outer ends of the arms 108 and 109 and connect at their upper ends 113 to be moved up and down by a lever arm 112. For moving the mechanism to the spread position for threading, a rod 115 is pivotally connected at 114 to the end of the lever arm 112 and a jack 116 lowers the rod to threading position or raises it to operating position. For loading the blades in coating position, the other end of the lever arm 112 is pushed upwardly by an inflatable bellows 117. The bellows is mounted on a support 118. A stop 119 supports the lever arm 112 when the bellows is collapsed.

The cross rods 104 and 105 have downwardly extending arms 120 and 121 which carry the distributing and applying blades 123 and 124. The base of the blades 123 and 124 are suitably supported on the arms. The lower ends of the blades will curve in a natural arc as the arms are pressed together, and inflatable tubes 125 and 126 are positioned for backing the blades in advance of the nip. The blades, similar to the blades as described in connection with FIG. 1, have a smooth inner surface and when pressed together, curve in a natural arc so that their curvature is tangent to the outer surface of the web. This curvature creates a gradually increasing hydraulic pressure against the coating in the nip and gradually releases the pressure on the off-running side.

The space between the blades is filled with a puddle of coating supplied by supply lines 128 and 129. An end dam 127 is positioned at the end of the space between the arms to prevent the coating from falling freely from the end. Edge pans 130 are positioned beneath the end dam to catch coating as the end dam is moved outwardly for clean-up and threading. The end dam and edge pans are mounted on a reciprocating head 131 supported in a bearing 132. The hydraulic cylinder 133 is provided for sliding the end dam outwardly to clean-up position or inwardly to operating position which is the position shown in FIG. 6. The edge pan remains positioned below the end dam at both positions.

Preferably a continuous flow of coating is maintained in the V groove between the arms and for this purpose overflow lines 134 and 135 lead excess coating from the space between end dams and lead to save-all pans 136 and 137. Pan 136 is movable to a position in the path of the web as shown by the dotted line position 136' to catch coating in the event of the sheave break.

Thus, it will be seen that in the various arrangements shown in the preceding drawings, the web travels through a vertical path, coating is applied, and the coating is smoothed by unique opposed flexible bent blades which operate and meeth the objectives and advantages above set forth.

What is claimed:

1. A mechanism for applying liquid coating to coat the surfaces of a continuous traveling web with a smooth coating finish comprising in combination:

means guiding a traveling web along a coating path through a coating station;

a coating applying means at said station applying a continuous layer of coating to each side of the traveling web;

first and second opposed thin flexible smoothing blades positioned after the coating station in said coating path with each having a smooth continuous uniform smoothing surface facing the web so that said surface will have an arc of curvature as said blade is pressed toward the web;

and first and second blade supporting and loading means positioned to respectively support the blades on each side of the web with the blades positioned so that said arc of curvature of the blades will be tangent to the planes of the surfaces of the traveling web as the blade loading means presses the blades toward each other.

2. A mechanism for applying liquid coating to coat the surfaces of a continuous traveling web with a smooth coating finish constructed in accordance with claim 1, wherein said blades of a length so that said arc of curvature extends away from the web downstream of the point of tangency in the direction the web travels.

3. A mechanism for applying liquid coating to coat the surfaces of a continuous traveling web with a smooth coating finish constructed in accordance with claim 1, where said blades have uniform flexibility along their length.

4. A mechanism for applying liquid coating to coat the surfaces of a continuous traveling web with a smooth coating finish constructed in accordance with claim 1, wherein said blades are of uniform thickness in the direction of web travel.

5. A mechanism for applying liquid coating to coat the surfaces of a continuous traveling web with a smooth coating finish constructed in accordance with claim 1, wherein said guiding means is positioned so that said web travels upwardly through said coating station and said blades extend upwardly in the direction of web travel.

6. A mechanism for applying liquid coating to coat the surfaces of a continuous traveling web with a smooth coating finish constructed in accordance with claim 5, wherein said applying means applies an excess coating and the excess coating flows gravitationally downwardly.

7. A mechanism for applying liquid coating to coat the surfaces of a continuous traveling web with a smooth coating finish constructed in accordance with claim 6, wherein said applying means includes a continuous elongate pressure opening at each side of the web with means for delivering coating under pressure to said opening.

8. A mechanism for applying coating to coat the surfaces of a continuous traveling web with a smooth coating finish constructed in accordance with claim 5, including a guard blade at each side of the web, each having an upwardly facing coating deflecting surface terminating at an edge in close running relationship to the coating surface and deflecting any droplets of coating falling downwardly away from the web surface.

9. A mechanism for applying liquid coating to coat the surfaces of a continuous traveling web with a smooth coating finish constructed in accordance with claim 5, including a mount for said blades supporting and loading means with said supporting and loading means movable between a first operating position and a second threading position away from the web.

10. A mechanism for applying liquid coating to coat the surfaces of a continuous traveling web with a smooth coating finish constructed in accordance with claim 1, wherein said blade loading means includes a common force applying means applying simultaneously uniform force to each of the blades.

11. A mechanism for applying liquid coating to coat the surfaces of a continuous traveling web with a smooth coating finish constructed in accordance with claim 1, including first and second hollow resilient tubes respectively for the blades coextensive therewith and in supporting engagement with the surface of the blade facing away from the web.

12. A mechanism for applying liquid coating to coat the surfaces of a continuous traveling web with a smooth coating finish constructed in accordance with claim 1, wherein said blade supporting and loading means includes first and second arms for the blades respectively with the upstream edges of the blades supported on the arms and including resilient means between the downstream ends of the arms and the downstream ends of the blades applying a uniform resilient force along the length of the blade tranversely of the direction of web movement.

13. A mechanism for applying liquid coating to coat the surfaces of a continuous traveling web with a smooth coating finish comprising in combination:

means guiding a traveling web along a coating path through a coating station;

first and second coating applicators respectively positioned at each side of the web with each applicator having a pressure coating opening extending continuously across the web;

means for applying coating under pressure to each of said openings; said web passing through said coating station in a vertical up direction;

a smooth surfaces shoe positioned immediately after said openings on each side of the web for distributing the coating;

and opposed first and second thin flexible smoothing blades positioned above said openings extending in the direction of web travel for applying a smoothing pressure to the coating on the traveling web with the blades forming arcs tangent to the web surfaces.

14. A mechanism for applying liquid coating to coat the surfaces of a continuous traveling web with a smooth coating finish comprising in combination:

vertically sequentially positioned coating applying and smoothing elements including applying means at each side of said web applying a continuous layer of coating to each side of the traveling web with excess coatingfalling downwardly;

first opposed deflector means below said applying means extending in close running relationship with the web on each side thereof and deflecting falling coating away from the web;

first and second opposed thin flexible smoothing blades pressed against the web above said applying means for smoothing the coating and forming arcs tangent to the surfaces of the belt;

and a second deflector means positioned between the applying means and the smoothing blades in close running relationship with the web on each side thereof deflecting coating falling downwardly away from the surfaces of the traveling web.

* * * * *